US009103098B2

(12) United States Patent
Zhu

(10) Patent No.: US 9,103,098 B2
(45) Date of Patent: Aug. 11, 2015

(54) AUTO CRAB OPERATION FOR MOTOR GRADER

(75) Inventor: Yongliang Zhu, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 145 days.

(21) Appl. No.: 13/568,825

(22) Filed: Aug. 7, 2012

(65) Prior Publication Data

US 2014/0041884 A1 Feb. 13, 2014

(51) Int. Cl.

| | |
|---|---|
| ***G06F 7/00*** | (2006.01) |
| ***E02F 3/85*** | (2006.01) |
| ***E02F 3/76*** | (2006.01) |

(52) U.S. Cl.

CPC ..... *E02F 3/764* (2013.01)

(58) Field of Classification Search

USPC ..... 37/347, 348; 172/2–11, 190, 811, 818, 172/820; 180/22–24, 24.01, 24.03, 24.04, 180/24.1, 24.09, 338, 418, 419, 197, 249, 180/253, 271, 6.44; 701/50, 51, 83, 88, 701/209, 210

See application file for complete search history.

(56) References Cited

U.S. PATENT DOCUMENTS

| | | | | |
|---|---|---|---|---|
| 4,364,438 | A * | 12/1982 | Pyle | 172/789 |
| 4,802,545 | A | 2/1989 | Nystuen et al. | |
| 4,926,948 | A | 5/1990 | Davidson et al. | |
| 5,584,346 | A | 12/1996 | Sakamoto et al. | |
| 5,908,081 | A | 6/1999 | Olson | |
| 6,062,317 | A | 5/2000 | Gharsalli et al. | |
| 6,112,145 | A * | 8/2000 | Zachman | 701/50 |
| 6,505,701 | B2 | 1/2003 | Juul et al. | |
| 6,655,492 | B2 | 12/2003 | Juul et al. | |
| 7,712,559 | B2 | 5/2010 | Yeoman et al. | |
| 7,721,842 | B2 | 5/2010 | Forero | |
| 7,766,104 | B2 * | 8/2010 | Newberry et al. | 180/24.09 |
| 2007/0250236 | A1 | 10/2007 | Newberry et al. | |
| 2008/0208461 | A1 * | 8/2008 | Gharsalli et al. | 701/209 |
| 2011/0035109 | A1 | 2/2011 | Ryerson et al. | |

* cited by examiner

*Primary Examiner* — Robert Pezzuto
(74) *Attorney, Agent, or Firm* — Miller, Matthias & Hull LLP

(57) ABSTRACT

An apparatus and method are provided for assisting an operator of a motor grader to steer the motor grader in a crab steer mode. The method includes receiving an operator selection of an automatic crab steer mode, determining that a condition of the motor grader is such as to permit automatic crab steer, and receiving an operator steering command. The received operator steering command is converted to an articulation command to place the machine into a crab steer mode. The articulation command is executed and is also converted into a final steering command consistent with the articulation command, and the final steering command is then executed.

21 Claims, 6 Drawing Sheets

AUTO CRAB OPERATION FOR MOTOR GRADER

TECHNICAL FIELD OF THE DISCLOSURE

The present disclosure relates to motor grader operation and, more particularly, relates to a system and method for automatically controlling machine steering to place or maintain the machine in a crab steer position.

BACKGROUND OF THE DISCLOSURE

A motor grader is a versatile apparatus for road work, ditch work, site preparation and other surface contouring and finishing tasks. A significant amount of a motor grader's versatility is provided by its multiple course setting and course change options. In particular, a motor grader typically includes a steering function implemented via steerable ground engaging wheels while also allowing some degree of course correction or steering via lateral arching or articulation of the machine frame. In this manner, for example, a motor grader may be steered and articulated to follow a curve without driving the rear wheels across the area inside the curve.

Another type of operating mode made possible by the motor grader's multiple course setting options is sometimes referred to as "crab steer" or the "crab" position. Crab steer, or the crab position, is a mode in which the front and rear wheel sets are not inline but are nonetheless parallel with one another. In this position, the motor grader moves along a line that is nonparallel to the machine axis.

The possible reasons for operating the motor grader in this position are many. For example, crab steering allows the motor grader to grade a stretch of roadway without driving the machine's rear wheels over just-graded roadway portions. Thus for example, the machine front wheels may be on the roadway while the rear wheels may be off the roadway entirely, and the machine is nonetheless able to travel parallel to the roadway. Other benefits to operating in a crab steer mode include, for example, increased side slope stability, allowing off setting of tandems away from edge fill for safety or to prevent road shoulder rutting, and allowing the operator to level truck-dumped material without running the front of the machine over the pile.

However, due to roadway curvature, slight machine perturbations, and so on, it can be difficult to maintain a crab steer mode for an extended period of time. In particular, maintaining accurate crab steer normally requires the operator to note any deviations, determine whether the noted deviation is due to a steering or articulation inaccuracy, and then make the necessary primary corrections and any necessary secondary corrections.

While there are certain automatic steering solutions described for use in motor graders, these solutions do not solve the problem of maintaining a crab position for an extended period of time. For example, U.S. Published Patent Application 20110035109 describes a system wherein machine articulation is automatically controlled based on machine steering. However, the system of the '109 application adjusts machine articulation to maintain tracking between the front and rear wheels of the machine. See '109 application at [0051].

The present disclosure is directed to a system and method that address one or more of the problems set forth above. However, it should be appreciated that the solution of any particular problem is not a limitation on the scope of this disclosure nor of the attached claims except to the extent expressly noted. Additionally, the inclusion of any problem or solution in this Background section is not an indication that the problem or solution represents known prior art except as otherwise expressly noted.

SUMMARY OF THE DISCLOSURE

In accordance with one aspect of the present disclosure, a method is provided for assisting an operator of a motor grader supporting both steering and articulation to steer the motor grader in a crab steer mode. The motor grader having front steerable wheels and a set of rear tandems mounted to an articulating frame, and the method includes receiving an operator selection of an automatic crab steer mode, determining that a condition of the motor grader is such as to permit automatic crab steer, and receiving an operator steering command. The received operator steering command is converted to an articulation command to place the machine into a crab steer mode, the articulation command is executed and is also converted into a final steering command consistent with the articulation command, and the final steering command is then executed.

In accordance with another aspect of the present disclosure, a method is provided for automatically directing a motor grader. The motor grader has one or more steerable front wheels and one or more rear wheels attached to a frame that is able to articulate. The method includes receiving a command from an operator of the motor grader, the command being one of a steering command and an articulation command, and in response to the command, automatically articulating the frame and steering the steerable front wheels such that the one or more rear wheels are parallel to but do not track the one or more steerable front wheels.

In accordance with yet another aspect of the present disclosure, a motor grader is provided having an automatic crab steer function. The motor grader includes one or more steerable front wheels mounted on a front portion of the motor grader and one or more rear wheels attached to a rear portion of the motor grader that may be articulated relative to the front portion. A controller is configured for receiving one of an operator steering command and an operator articulation command and in response generating both a steering command to steer the one or more front wheels and an articulation command to articulate the rear portion of the frame relative to the front portion, such that the one or more rear wheels become parallel to but do not track the one or more steerable front wheels.

Other features and advantages of the disclosed systems and principles will become apparent from reading the following detailed disclosure in conjunction with the included drawing figures.

DETAILED DESCRIPTION OF THE DISCLOSURE

The present disclosure provides a system and method for enabling a motor grader operator to maintain the machine in a crab steer position automatically. In particular, for both position-based and speed-based joystick steering configurations, the operator is able to select an automatic crab mode and have the machine steering respond to articulation and/or steering commands in such a way as to maintain the machine in a crab steer position.

For position-based joystick steering configurations, i.e., those wherein the position of the joystick is used generally to set the steering angle of the machine steerable wheels, the automatic crab system responds, when properly activated, by adjusting the joystick position. For speed-based joystick steering configurations, the automatic crab system responds to articulation commands, when properly activated, by simply adjusting machine steering without modifying the joystick position. In an embodiment, a steering command may be belayed, translated to an articulation command, executed as such, and then the steering may be adjusted to provide the appropriate crab steer.

In an embodiment, the automatic crab steer setting is locked out at certain speed ranges or gear ranges. This prevents automatic crabbing of the machine at a time when the machine is travelling too fast to travel in a crab position, e.g., when travelling in a transportation mode as opposed to a working mode.

Figure 1:
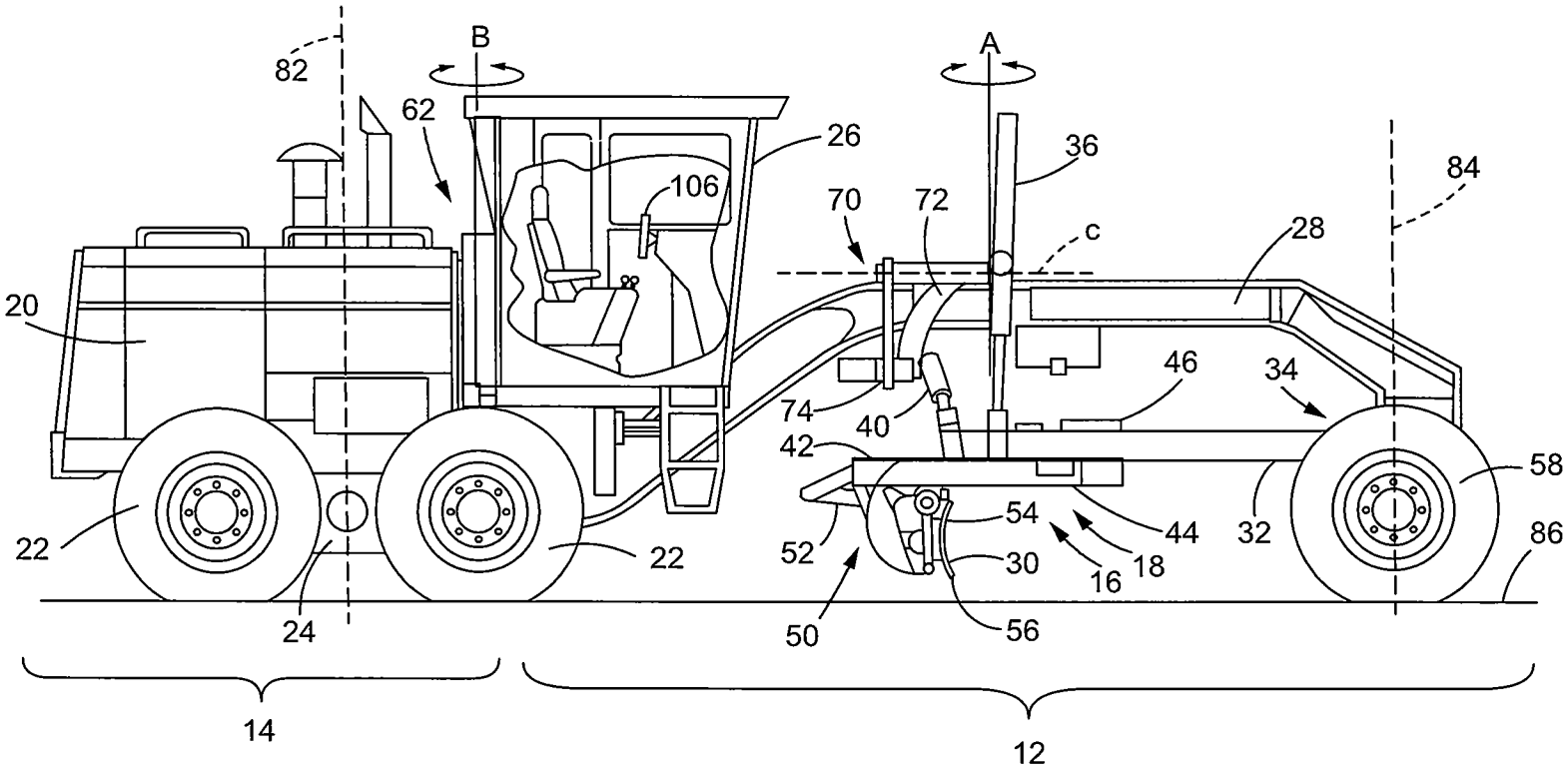
FIG. 1 is a schematic side view of a motor grader within which one or more embodiments of the present disclosure may be implemented.

Having discussed several embodiments in overview, we turn now to detailed descriptions of certain embodiments. FIG. 1 is a schematic side view of a motor grader in accordance with one embodiment of the present disclosure. The motor grader 10 includes a front frame 12, rear frame 14, and a work implement 16, e.g., a blade assembly 18, also referred to as a drawbar-circle-moldboard assembly (DCM). The rear frame 14 includes a power source (not shown), contained within a rear compartment 20, that is operatively coupled through a transmission (not shown) to rear traction devices or wheels 22 for primary machine propulsion.

As shown, the rear wheels 22 are operatively supported on tandems 24 which are pivotally connected to the machine between the rear wheels 22 on each side of the motor grader 10. The power source may be, for example, a diesel engine, a gasoline engine, a natural gas engine, or any other engine known in the art. The power source may also be an electric motor linked to a fuel cell, capacitive storage device, battery, or another source of power known in the art. The transmission may be a mechanical transmission, hydraulic transmission, or any other transmission type known in the art. The transmission may be operable to produce multiple output speed ratios (or a continuously variable speed ratio) between the power source and driven traction devices.

The front frame 12 supports an operator station 26 that contains operator controls, along with a variety of displays or indicators used to convey information to the operator, for primary operation of the motor grader 10. The front frame 12 also includes a beam 28 that supports the blade assembly 18 and which is employed to move the blade 30 to a wide range of positions relative to the motor grader 10. The blade assembly 18 includes a drawbar 32 pivotally mounted to a first end 34 of the beam 28 via a ball joint (not shown). The position of the drawbar 32 is controlled by three hydraulic cylinders: a right lift cylinder 36 and left lift cylinder 38 (FIG. 2) that control vertical movement, and a center shift cylinder 40 that controls horizontal movement. The right and left lift cylinders 36, 38 are connected to a coupling 70 that includes lift arms 72 pivotally connected to the beam 28 for rotation about axis C. A bottom portion of the coupling 70 has an adjustable length horizontal member 74 that is connected to the center shift cylinder 40.

Figure 2:
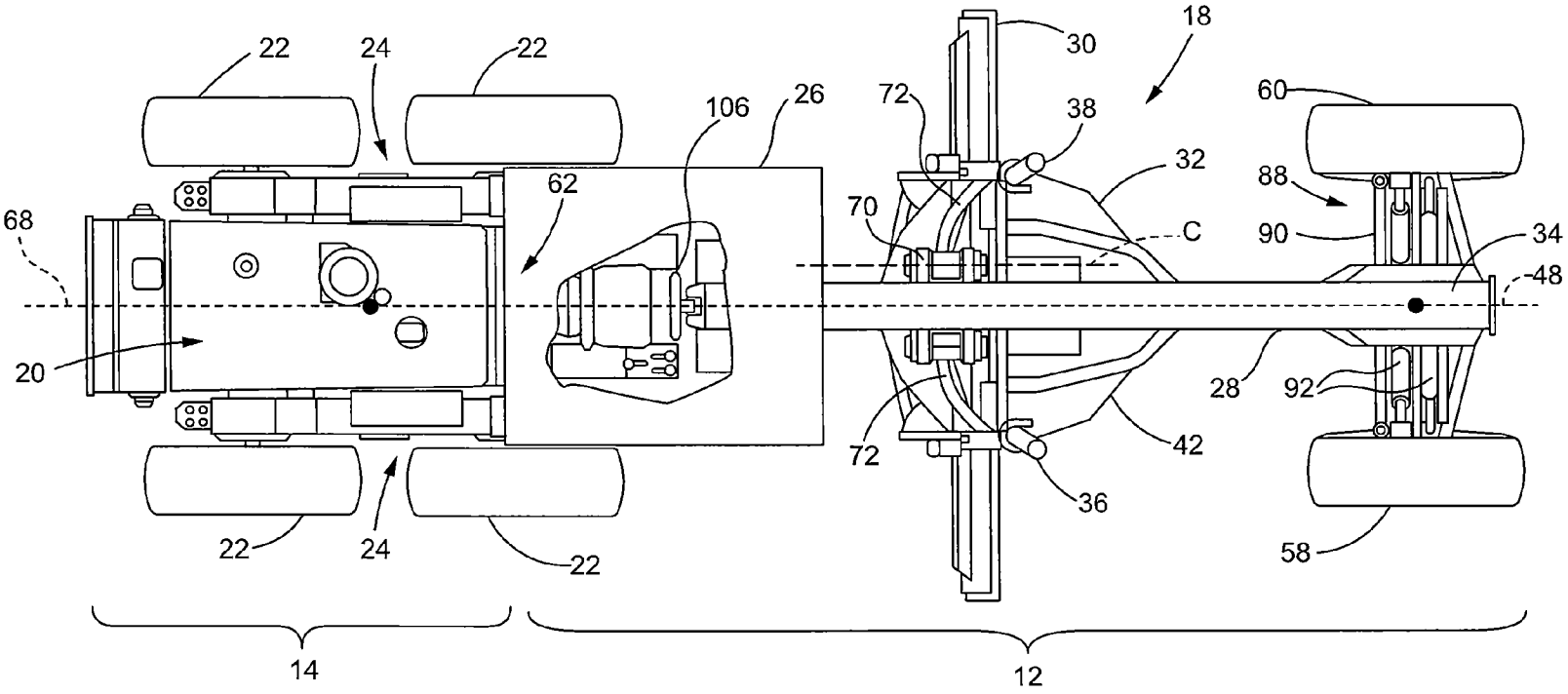
FIG. 2 is a schematic top view of a motor grader within which one or more embodiments of the present disclosure may be implemented.

The drawbar 32 includes a large, flat plate, commonly referred to as a yoke plate 42. Beneath the yoke plate 42 is a circular gear arrangement and mount, commonly referred to as the circle 44. The circle 44 is rotated by, for example, a hydraulic motor referred to as the circle drive 46. Rotation of the circle 44 by the circle drive 46 rotates the attached blade 30 about an axis A perpendicular to a plane of the drawbar yoke plate 42. The blade cutting angle is defined as the angle of the blade 16 relative to a longitudinal axis 48 of the front frame 12. For example, at a zero degree blade cutting angle, the blade 30 is aligned at a right angle to the longitudinal axis 48 of the front frame 12 and beam 28 (FIG. 2).

The blade 30 is also mounted to the circle 44 via a pivot assembly 50 that allows for tilting of the blade 30 relative to the circle 44. A blade tip cylinder 52 is used to tilt the blade 30 forward or rearward. In other words, the blade tip cylinder 52 is used to tip or tilt a top edge 54 relative to the bottom cutting edge 56 of the blade 30, which is commonly referred to as blade tip. The blade 30 is also mounted to a sliding joint associated with the circle 44 that allows the blade 30 to be slid or shifted from side-to-side relative to the circle 44. The side-to-side shift is commonly referred to as blade side shift. A side shift cylinder (not shown) is used to control the blade side shift.

Motor grader course direction is accomplished through a combination of both front wheel steering and machine articulation. As shown in FIG. 2, steerable traction devices, right and left wheels 58, 60, are associated with the first end 34 of the beam 28. Wheels 58, 60 may be both rotatable and tiltable for use during steering and leveling of a work surface 86 (FIG. 1). Front wheels 58, 60 are connected via a steering apparatus 88 that may include a linkage 90 and a hydraulic cylinder (not shown) for rotation about front wheel pivot points 80, FIG. 3, and tilt cylinders 92 for front wheel tilt. Front steerable 58, 60 and/or rear driven traction devices 22, may include tracks, belts, or other traction devices as an alternative to wheels as is known in the art. The front wheels 58, 60 may also be driven, as is the case in motor graders provided with all wheel drive. For example, the power source may be operatively connected to a hydraulic pump (not shown) fluidly coupled to one or more hydraulic motors (not shown) associated with the front wheels 58, 60.

Figure 3:
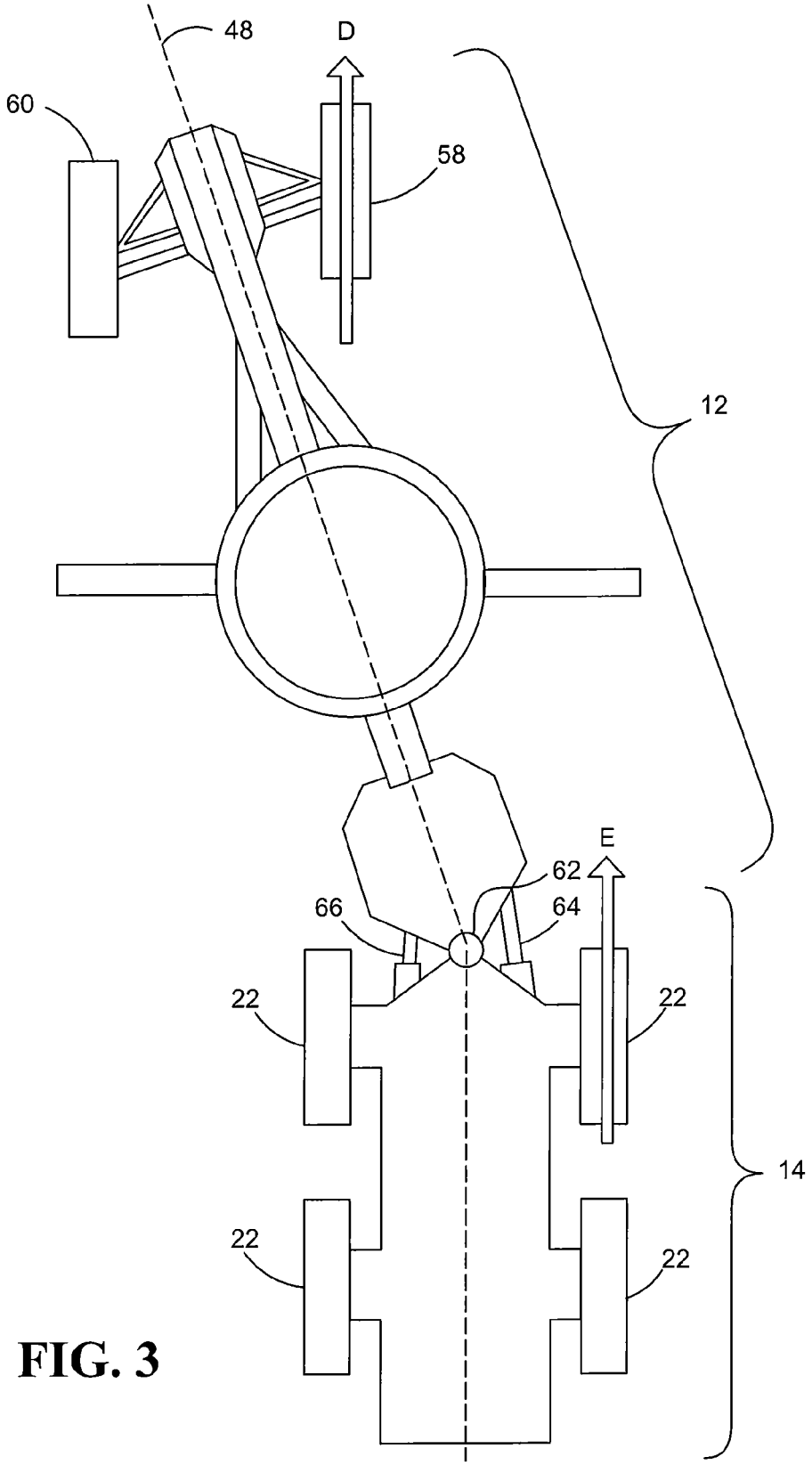
FIG. 3 is a schematic top view of a motor grader during a crab steer mode of operation in accordance with one or more embodiments of the present disclosure.

Referring to FIGS. 1 and 3, the motor grader 10 includes an articulation joint 62 that pivotally connects front frame 12 and rear frame 14. Both a right articulation cylinder 64 and left articulation cylinder 66 (FIG. 3) are connected between the front frame 12 and rear frame 14 on opposing sides of the machine 10. The right and left articulation cylinders 64, 66 are used to pivot the front frame 12 relative to the rear frame 14 about an articulation axis B (FIG. 1). In FIG. 2, the motor grader 10 is positioned in the neutral or zero articulation angle position wherein the longitudinal axis 48 of the front frame 12 is aligned with a longitudinal axis 68 of the rear frame 14.

In contrast, in FIG. 3, the motor grader 10 is positioned in the crab steer position wherein the longitudinal axis 48 of the front frame 12 is not aligned with the longitudinal axis 68 of the rear frame 14. Note, however, that in the illustrated crab steer position, the front wheel 58, 60 direction D is aligned with the direction E of the rear tandems 22.

As noted above, it can be difficult for an operator to maintain the motor grader in a crab steer position for an extended period of time due to the many ongoing adjustments required. However, in an embodiment, the operator is able to select automatic crab steer control to assist in maintaining the crab steer position.

Steering in a motor grader is most often accomplished via an operator-controlled joystick. There are two primary types of joystick control, namely position-based, wherein the angle of steering is directly related to the position of the joystick, and speed-based, wherein the normal position of the joystick is neutral, and deviations from neutral by the operator serve as commands to steer further in the indicated direction. With respect to crab steer control, it is desirable to have the position of the joystick in position-based systems still match the actual steering angle to avoid mismatches between the joystick and the steering angle during transition phases. In other words, when engaging and disengaging the automatic crab steer mode, it is desirable to avoid sudden discontinuities in joystick position.

Figure 4:
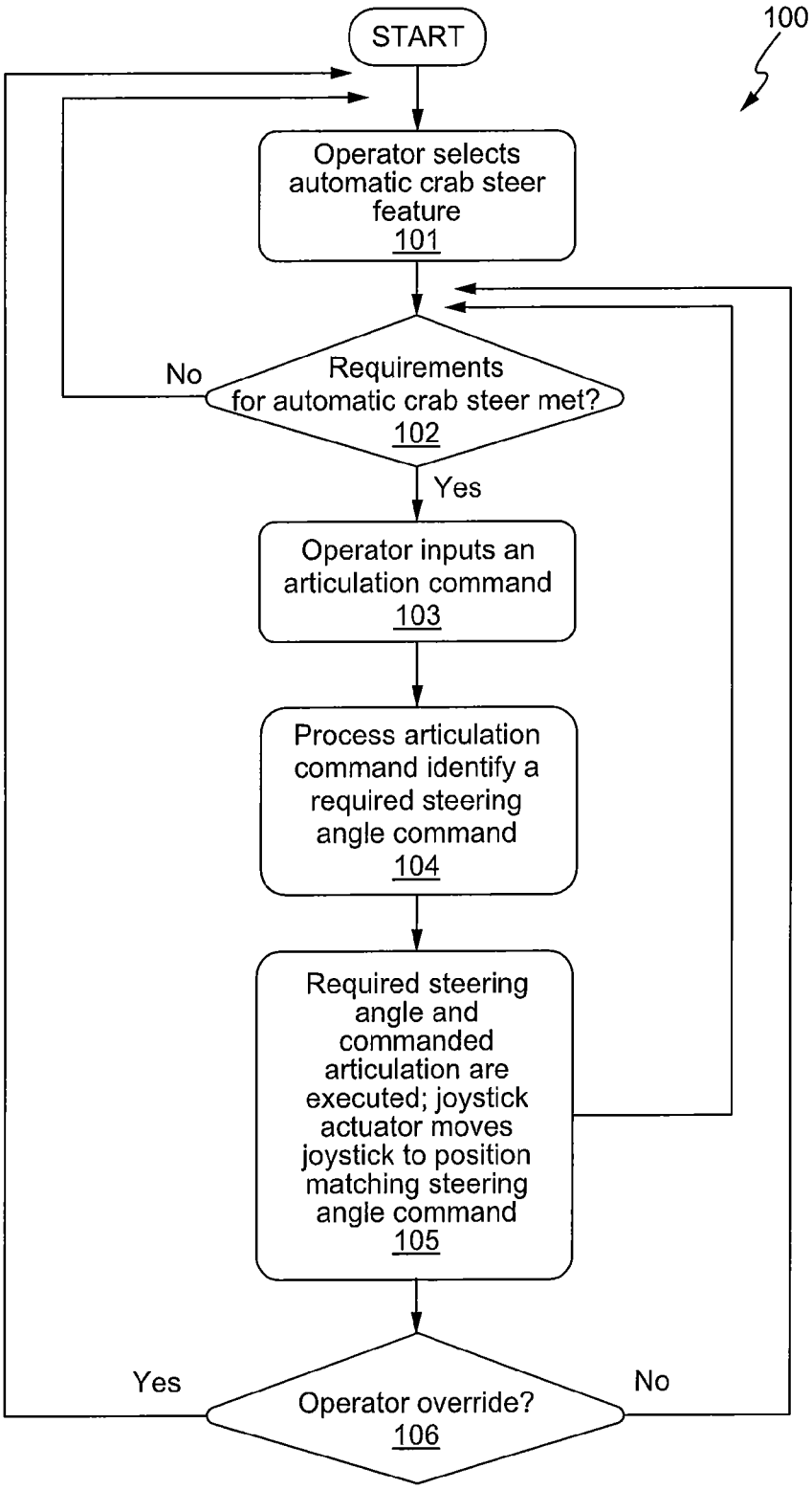
FIG. 4 is a flow chart showing a process of implementing an automated crab steer mode in accordance with an aspect of the disclosure.

Thus, in an embodiment wherein the joystick is position-based, a joystick actuator is used to set the joystick position during automatic crab steering. This will be apparent from the process 100 illustrated by way of the flow chart of FIG. 4. At stage 101 of the process 100, the operator first selects the automatic crab steer feature. Selection of the feature may be made by way of a switch, button, operator interface icon, and so on.

As noted above, the feature may be locked out for certain gears and/or machine speeds. For example, if the machine is in any reverse gear, is in a gear higher than the second forward speed, or is travelling in excess of 10 MPH, the automatic crab steer feature may not be engageable. Thus, at stage 102, it is determined whether the requirements for engaging the automatic crab steer mode are met. If the requirements for engaging the automatic crab steer mode are not met, the process 100 returns to await another attempt to engage the automatic crab steer mode. Otherwise, the process 100 continues forward to stage 103.

With the automatic crab steer feature activated, the operator inputs an articulation command at stage 103 in the normal manner. The articulation command is then processed to identify a required steering angle at stage 104, the required steering being the angle needed to position the steering wheels to roll generally parallel, though not in track with, the rear tandems. Thus, a greater articulation angle would require a greater steering angle.

At stage 105, the identified required steering angle and commanded articulation are executed, and substantially simultaneously, the joystick actuator is actuated to move the joystick to a position matching the identified required steering angle. After this stage, the motor grader is crabbed to a position set by the articulation command, and the steering joystick is positioned in accordance with a matching front wheel steering angle.

As noted above, in an embodiment, the operator may override any automatic action taken in the automatic crab steer mode. Thus, at stage 106, the process 100 determines whether an operator override has been received by the system. If an override has been received, the process 100 terminates the automatic crab steer mode and returns to await further operator input at stage 101. Otherwise, the process 100 returns to stage 102 to again verify that all requirements for the mode are met and to await further operator articulation input.

In another embodiment, the operator's steering input is used to set the crab angle in automatic crab steer mode, and a joystick actuator is not used. In accordance with this aspect, as shown in the process 110 of FIG. 5, the operator first selects the automatic crab steer feature at stage 111. Selection of the feature may be made in any manner including those described above.

Figure 5:
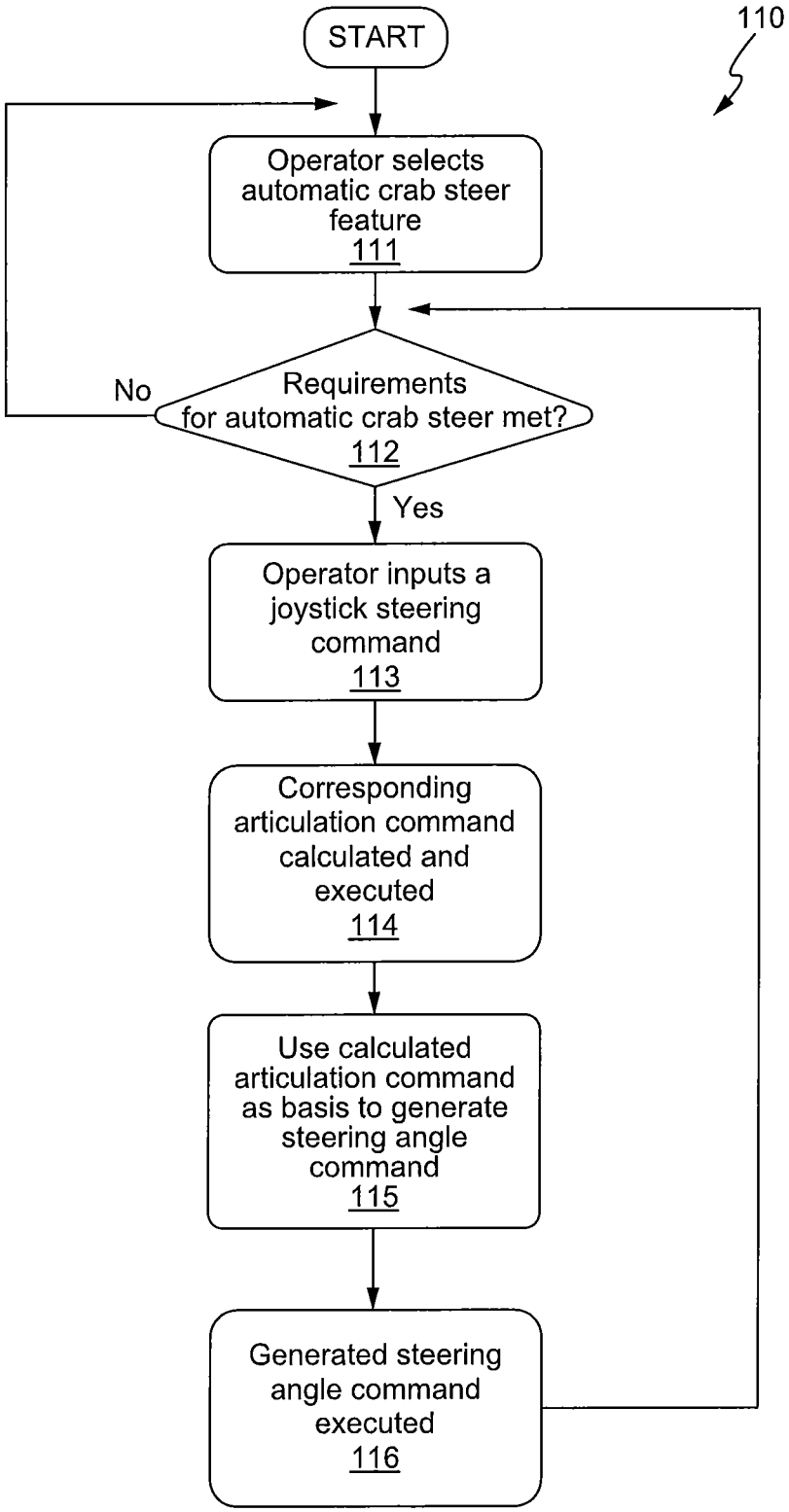
FIG. 5 is a flow chart showing a process of implementing an automated crab steer mode in accordance with an alternative aspect of the disclosure.

Although not expressly shown in FIG. 5, it will be appreciated that, as with prior embodiments, the operator may override the automatic crab steer mode. If at any time during the process 110 the operator does override any automatic action, be it steering or articulation, then the process 111 exits the automatic crab steer mode and awaits further user input.

As in the prior embodiment, the process 110 first checks at stage 112 to verify that the requirements for entering the crab steer mode are met. For example, the requirements for entering the crab steer mode may include that the machine speed be at or below a certain speed, that the machine transmission gear be at or below a certain gear, and so on. If the requirements are found not to be met, then the process 110 returns to await another operator attempt to engage the automatic crab steer mode.

Otherwise, the process 110 continues to stage 113, wherein the operator inputs a steering joystick command. Based on the joystick command, a required articulation angle is calculated and executed at stage 114, but is also used at stage 115 as a basis to calculate a desired steering angle. The steering angle command is executed at stage 116.

This process avoids having an operator oversteer the motor grader while in automatic crab steering mode to a degree that the available articulation is not sufficient to allow crab steering. For example, the available range of articulation for a particular motor grader may be from about −20 to +20 degrees, whereas the available range of wheel steering for the same machine may be from about −47 to about +47 degrees. Thus, if the operator were to immediately input 30 degrees of wheel steering, the available articulation would not be sufficient to allow crab steering.

In an embodiment, an indicator is provided to the operator in the event that the input steering exceeds the amount allowable in crab steering mode. Thus, in the above example, if the operator commands 30 degrees of wheel steering while in crab steering mode, the process may limit the steering to an amount within which crab steering is still possible, e.g., 20 degrees. At the same time, a blinking light, audible alarm, or other indicator may alert the operator that the steering command has been truncated to allow for crab steering.

Similarly, an audible or visual indication may be provided upon an unsuccessful attempt to engage the automatic crab steer mode. This, may occur, for example, when the machine is travelling too fast or in too high a gear to allow crab steer.

When the operator chooses to exit the automatic crab steering mode, by selecting an appropriate icon on an in-cab display or actuating the appropriate switch or button, in an embodiment the articulation and steering controls return to their normal function. Thus, for example, the operator could continue to crab steer the machine manually or could revert to another mode of operation. Alternatively, the machine is reverted to an essentially in-line mode once the automatic crab steer mode is deactivated. Thus, for example, the articulation and steering angles may be returned to zero.

Figure 6:
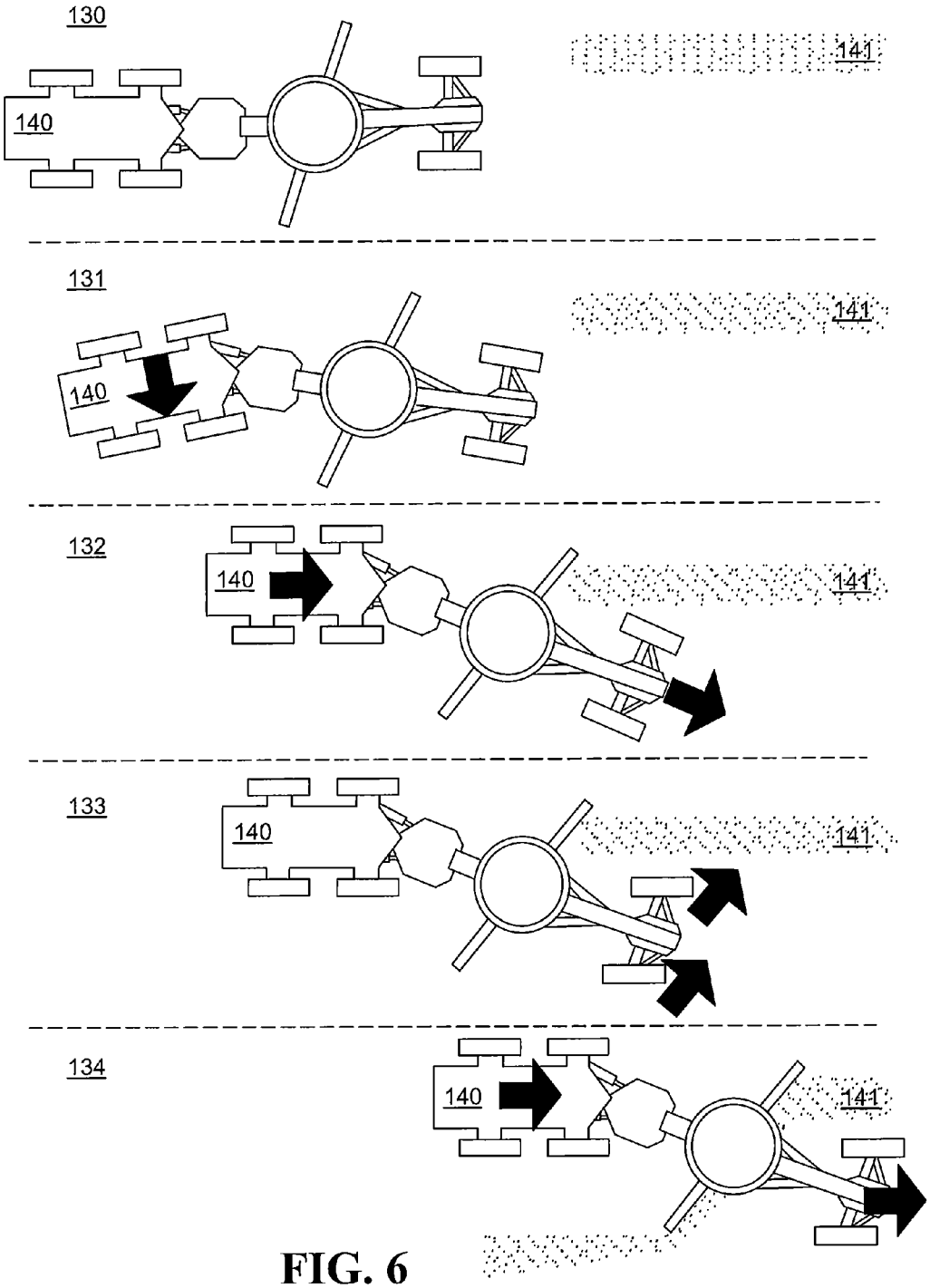
FIG. 6 is an illustrative state chart showing different machine states during engagement of an automated crab steer mode in accordance with an aspect of the disclosure.

The effect of a steering command when in the automatic crab steer mode are shown in FIG. 6. Initially, the machine 140 in state 130 is in an essentially in-line configuration relative to a line of debris 141 to be shifted. In state 131, the operator selects the automatic crab steer mode and inputs a 20 degree left steering input. The machine articulation is first adjusted to initiate a crab position and as the machine moves forward in state 132 it assumes an off-center position relative to the debris line. At this point in state 133, the 20 degree left steer command is execute and the front wheels pivot so that they are parallel to the rear tandems and the debris pile 141. The machine 140 is now in a crab steer mode, and as it moves forward at state 134, the line of debris 141 is shifted under the machine 140 by the blade.

INDUSTRIAL APPLICABILITY

In general terms, the present disclosure sets forth a system and method applicable to motor graders and the like wherein it is desired to provide an automatic crab steer mode of operation. The crab steer mode of operation allows the operator to maintain the front wheels of the motor grader and the rear tandems of the motor grader in parallel but out of track positions. This permits the motor grader to gain increased side slope stability, and also allows the operator to offset the tandems away from edge fill for safety or to prevent road shoulder rutting. The crab steer mode further assists the operator in leveling or shifting truck-dumped material without running the machine over the pile to be leveled or shifted.

The automatic crab steer mode is instantiated and executed via the computerized execution of instructions stored on a nontransitory computer-readable medium or memory, e.g., a disc drive, flash drive, optical memory, ROM, etc. The executing entity may be one or more controllers and may be separate from or part of one or more existing controllers such as one or more engine controllers and/or transmission controllers.

It will be appreciated that the present disclosure provides a system and method for facilitating an automatic crab steer mode to improve operator convenience. While only certain embodiments have been set forth, alternatives and modifications will be apparent from the above description to those skilled in the art. These and other alternatives are considered equivalents and within the spirit and scope of this disclosure and the appended claims.

What is claimed is:

1. A method for assisting an operator of a motor grader, having both steering and articulation, to steer the motor grader in a crab steer mode, the motor grader having front steerable wheels and a set of rear tandems mounted to an articulating frame, the method comprising:

receiving an operator selection of an automatic crab steer mode;

determining that a condition of the motor grader is such as to permit automatic crab steer;

receiving an operator steering command; and converting the received operator steering command to an articulation command to place the motor grader into a crab steer mode, executing the articulation command, converting the articulation command to a final steering command consistent with the articulation command and executing the final steering command.

2. The method according to claim 1, wherein receiving an operator selection of an automatic crab steer mode comprises receiving a selection of a button or switch by the operator within a cab of the motor grader.

3. The method according to claim 1, wherein determining that a condition of the motor grader is such as to permit automatic crab steer includes determining that the motor grader speed is not greater than a predetermined threshold speed.

4. The method according to claim 3, wherein determining that a condition of the motor grader is such as to permit automatic crab steer further includes determining that a transmission speed range of the motor grader speed is not greater than a predetermined threshold transmission speed range.

5. The method according to claim 1, wherein receiving an operator steering command comprises receiving a joystick command from the operator.

6. The method according to claim 1, wherein the joystick is a speed-type joystick.

7. The method according to claim 1, wherein the joystick is a position-type joystick.

8. The method according to claim 1, wherein the front steerable wheels and the set of rear tandems are substantially parallel after the step of executing the final steering command.

9. The method according to claim 1, further including receiving an override command from the operator and in response, terminating the crab steer mode.

10. The method according to claim 1, wherein the override command is a joystick command from the operator overriding the final steering command.

11. The method according to claim 1, further including notifying the at least one condition prevents automatic crab steer.

12. The method according to claim 11, wherein notifying the user includes providing a visual or audible notification to the operator.

13. The method according to claim 11, wherein the at least one condition that prevents automatic crab steer includes a condition wherein wheel steering exceeds available articulation range.

14. A method of automatically directing a motor grader, the motor grader having at least one steerable front wheel and at least one rear wheel attached to a frame that is able to articulate, the method comprising:

receiving a command from an operator of the motor grader, the command being one of a steering command and an articulation command; and in response to the command automatically articulating the frame and steering the steerable front wheels such that the at least one rear wheel does not track the at least one steerable front wheel, but the at least one rear wheel is parallel to the at least one steerable front wheel.

15. The method according to claim 14, further comprising receiving an operator selection of an automatic crab steer mode prior to receiving the command.

16. The method according to claim 14, wherein the command is an articulation command, and wherein automatically articulating the frame and steering the steerable front wheel includes generating a steering command based on the articulation command.

17. The method according to claim 14, wherein the command is a steering command, and wherein automatically articulating the frame and steering the steerable front wheel includes generating an articulation command based on the steering command.

18. A motor grader having an automatic crab steer function, the motor grader comprising:

at least one steerable front wheel mounted on a front portion of the motor grader;

at least one rear wheel attached to a rear portion of the motor grader that may be articulated relative to the front portion; and a controller configured for receiving one of an operator steering command and an operator articulation command and in response generating both a steering command to steer the at least one front wheel and an articulation command to articulate the rear portion of the frame relative to the front portion, such that the at least one rear wheel become parallel to but do not track the at least one steerable front wheel.

19. The motor grader in accordance with claim 18, wherein the controller is further configured to allow the operator to override one or both of the steering command to steer the at least one front wheel and the articulation command to articulate the rear portion of the frame.

20. The motor grader in accordance with claim 18, wherein the controller is further configured to provide an alarm to the operator when the operator steering command or operator articulation command would exceed the ability of the motor grader to maintain a crab position.

21. The motor grader in accordance with claim 18, wherein the controller is further configured to exit the crab steer function if at least one parameter of the motor grader exceeds a preset threshold.

* * * * *